US005376256A

United States Patent [19]

Leutwyler

[11] Patent Number: 5,376,256

[45] Date of Patent: Dec. 27, 1994

[54] METHOD OF REMOVING CARBONATES FROM PLATING BATHS

[76] Inventor: René Leutwyler, Oberdorfstrasse 5, CH-5506 Mägenwil, Switzerland

[21] Appl. No.: 5,243

[22] Filed: Jan. 15, 1993

[30] Foreign Application Priority Data

Jan. 15, 1992 [DE] Germany ..... 4200774

[51] Int. Cl.[5] ..... B01D 9/02; C25D 21/18

[52] U.S. Cl. ..... 205/99; 205/101; 210/737

[58] Field of Search ..... 205/99, 101; 210/737

[56] References Cited

U.S. PATENT DOCUMENTS

| | | | |
|---|---|---|---|
| 2,787,590 | 4/1957 | Rinker | 205/99 |
| 2,861,927 | 11/1958 | Ceresa et al. | 205/99 |
| 3,661,734 | 5/1972 | Sloan | 205/99 |
| 4,049,519 | 9/1977 | Sloan | 204/180 P |
| 4,159,194 | 6/1979 | Steward | 23/301 |
| 4,278,515 | 7/1981 | Pearlstein et al. | 204/55 Y |
| 4,365,481 | 12/1982 | Pearlstein et al. | 204/274 X |

*Primary Examiner*—John Niebling

*Assistant Examiner*—William T. Leader

*Attorney, Agent, or Firm*—Tarolli, Sundheim & Covell

[57] ABSTRACT

Carbonates, and particularly sodium carbonate, are removed from cyanide containing plating baths by taking from said cyanide containing bath at least part of its bath liquid; stirring and cooling in a cooling container the token liquid while in the metastabile state until crystallization of the carbonates occurs; separating the crystallized carbonates from the liquid; and leading the residual liquor back to the plating bath. Preferably, the quantity of bath liquid taken from the plating bath and the moment of this taking are chosen so as to bring the carbonate content of said plating bath, after leading the residual liquor back to it, to a carbonate content of 25 to 45 grams/liter, and the cooling is continued until the exothermic reaction, which is caused by the liberation of the heat of crystallization, starts, and thereafter the mixture is still held for 2 to 4 minutes at 0.5° C. to 1° C. below this starting temperature. The method is useful for all kinds of cyanide containing baths and provides essential technical, ecological and economical advantages.

4 Claims, No Drawings

METHOD OF REMOVING CARBONATES FROM PLATING BATHS

TECHNICAL FIELD

The present invention relates to a method of removing carbonates, particularly sodium carbonate, from cyanide containing plating baths.

BACKGROUND OF THE INVENTION

During the use of plating baths, the carbonate content of the bath increases due to the action of the carbon dioxide contained in the air onto the alkali cyanides and alkali hydroxides, and the oxidation of said alkali cyanides.

In cyanide containing baths, in general a carbonate content of 25 to 40 grams/liter is useful. On the other hand, a carbonate content of above 60 grams/liter is harmful since the throwing power decreases;

the current efficiency rapidly decreases;

the bath composition is to be continuously completed; and the quality of the metallic coatings is definitely reduced, inasmuch that a lustrous deposit is no longer obtained and the metallic coatings are rough and become gradually stained.

So far, for removing said carbonates from the plating baths, the said baths were either (a) cooled in the open at temperatures slightly above or below the freezing point; or (b) cooled to +4 to 0° C. in a separate crystallization device by means of cooling elements, e.g. by dipping containers filled with carbon dioxide ice into the bath, or by passing a cooling medium through cooling coils, if necessary with addition if crushed ice; thereafter the hard carbonate layers deposited on the cooling elements were mechanically removed (cf. T. W. Jelinek, Galvanisches Verzinken, page 93 -Saulgau (Germany) 1982-ISBN 3-87480-010-5).

After separation of the removed carbonate, the residual liquor was again used in the plating baths.

The method (a) could not be tolerated under the environment legislation, and moreover could be executed only in winter. Other disadvantages were that the cooling generally had to be carried out uncontrolledly, so that often to much or to less carbonate was separated, and that at temperatures below the freezing there was the danger that the tub be burst.

The method (b), and particularly the mechanical removal the hard carbonate layers from the cooling elements, was complicated and expensive. Moreover, the separated crystallizate had to be waste disposed as a whole, since the carbonate components could not be re-dissolved.

OBJECT OF THE INVENTION

It is the object of the present invention to provide an method of removing carbonates from cyanide containing plating baths which avoids the above-mentioned disadvantages.

SUMMARY OF THE INVENTION

To meet this and other objects, the invention provides a method of removing carbonates, particularly sodium carbonate, from cyanide containing baths by cooling the bath liquid, said method comprising the steps of:

taking from said cyanide containing bath at least part of its bath liquid;

stirring and cooling in a cooling container the token liquid while in the metastabile state until crystallization of the carbonates occurs;

separating the crystallized carbonates from the liquid; and leading the residual liquor back to the plating bath.

Preferably, the quantity of bath liquid taken from the plating bath and the moment of taking said liquid are chosen so as to bring the carbonate content of said plating bath, after leading the residual liquor back to the plating bath, to a carbonate content of 25 to 45 grams/-liter, particularly to a carbonate content of 40 grams/-liter.

Preferably, the cooling is continued until the exothermic reaction, which is caused by the liberation of the heat of crystallization, starts, and thereafter the mixture is still held for 2 to 4 minutes at 0.5° to 1° C. below this starting temperature.

Preferably, the cooling speed in the cooling container is −0.3° to −0.7° C./minute, particularly −0.5° C./minute.

Preferably, the stirring apparatus used is a slow-speed cone stirrer (cf. Swiss Patent No. 675,215) sold by Viscojet AG, Basle (Switzerland), under the trade name "Viscojet". A preferred stirrer of this kind has a container diameter of 50 cm, a cone diameter of 32 cm, and is working at 60 to 100 r.p.m., preferably at 80 r.p.m. Under these conditions, no big crystals, and particularly no needleshaped crystals, can be formed.

The method according to the present invention is suitable for all kinds of cyanide containing baths, i.e. for metallic baths as well as for degreasing baths.

The method according to the present invention provides essential technical, ecological and economical advantages, the most important of them being as follows:

There are no deposits on the container walls and on the stirrer.

The separated carbonate can very easily be re-dissolved in cold water. So far, re-dissolution of crystallized carbonate, even in hot water, was very hard, if possible at all. As a result of this ease of re-dissolution, smaller quantities of waste water are produced, which in turn involve smaller labor and waste disposal costs.

In executing such waste disposal, the precipitated carbonate is preferably re-dissolved, and the small quantities of co-precipitated plating metal are electrolyticly separated from the obtained solution. Thereby, about 80% of the co-precipitated cyanides are oxidized to cyanates. At the same time, the zinc ions are reduced at the cathode to metallic zinc.

Moreover, the method according to the present invention avoids cooling in the open. As explained above, said cooling in the open was not tolerated under the environment legislation, and moreover could be executed only in winter. Thus, during the whole year a constant carbonate content can now be maintained. This has the positive effect that the platings are of a constant quality.

Finally, by suitablely choosing the quantity of bath liquid taken from the plating bath and the moment of taking said liquid, a carbonate content of said plating bath, after leading the residual liquor back to the plating bath, of 25 to 45 grams/liter, preferably of 40 grams/-liter, can be secured. This practically avoids the necessity of doing the time consuming $CO_3^{2-}$ analysis, as soon as the temperature control of the method once was optimized.

EXAMPLE

50 Liter of bath liquid were pumped from a cyanide containing zinc bath, having a carbonate content of 55 to 60 grams/ liter, into a cooling container of 50 cm diameter and of 35 cm height. Then, the solution was stirred by means of a stirring apparatus of the type "Viscojet 55 ST/v" having a stirrer diameter of 32 cm, at 80 r.p.m. Simultaneously, the cooling was started and was controlled so as to cause a cooling speed in the cooling container of −0.5° C./minute.

When a temperature of 4 to 5° C. was reached, an exothermic reaction, the so-called "temperature jump", caused by the liberation of the heat of crystallization of the fine-grained crystal suspension which was formed, happened.

Depending on the specific parameters of the cooling, this may result in a rise of temperature to 6° to 7° C., or the temperature may remain constant during some time despite applying a constant cooling performance. After occurrence of said temperature jump, cooling was continued for an after-time of another 3 minutes until a final temperature of 4° C. was reached. Then, the cooling aggregate was stopped. If said after-time is longer, a re-solvation of the sodium carbonate crystals already happens.

Thereafter, the obtained crystal suspension, in which the crystals are of a size of about 0.3 to 0.4 mm, was withdrawn from the cooling container under continued stirring and was filtered by means of a mesh size of 0.2 mm.

Thereafter, the apparatus, which did not show any deposits on its walls and stirrer, was cleaned. It was then ready for the treatment of another charge.

Preferably all essential parameters are automatically controlled by level control, temperature sensing and timer means.

What is claimed is:

1. A single stage method for removing carbonates from a cyanide containing bath, said method comprising the steps of:

removing from said cyanide containing bath at least part of its bath liquid;

stirring and cooling, in a cooling container, said part while in the metastable state until crystallization of carbonates occurs in said part;

continuing the cooling of said part until an exothermic reaction, which is caused by the liberation of the heat of crystallization, starts, said exothermic reaction starting at a set temperature;

thereafter holding said part for two to four minutes at 0.5° to 1° C. below said set temperature;

separating the crystallized carbonates from said part, leaving a residual liquor; and transferring said residual liquor back to said cyanide containing bath;

the quantity of said part removed from the cyanide containing bath and the moment of removing said part being chosen so as to bring the carbonate content of said cyanide containing bath, after transferring the residual liquor back to the cyanide containing bath, to a carbonate content of 25 to 45 grams per liter.

2. The method according to claim 1, wherein the quantity of said part removed from the cyanide containing bath and the moment of removing said part are chosen so as to bring the carbonate content of said cyanide containing bath, after transferring the residual liquor back to the cyanide containing bath, to a carbonate content of 40 grams/liter.

3. The method according to one of claim 1 or 2, wherein the cooling rate in the cooling container is −0.3° to −0.7° C./minute.

4. The method according to claim 3, wherein the cooling rate in the cooling container is −0.5° C./minute.

* * * * *